US005148099A

United States Patent [19]

Ong

[11] Patent Number: 5,148,099

[45] Date of Patent: Sep. 15, 1992

[54] RADIATION HARDENED BANDGAP REFERENCE VOLTAGE GENERATOR AND METHOD

[75] Inventor: Richard H. Ong, Phoenix, Ariz.

[73] Assignee: Motorola, Inc., Schaumburg, Ill.

[21] Appl. No.: 678,375

[22] Filed: Apr. 1, 1991

[51] Int. Cl.[5] ..... G05F 3/20

[52] U.S. Cl. ..... 323/314; 323/316; 323/907

[58] Field of Search ..... 323/313, 314, 315, 316, 323/907; 307/296.1, 296.6

[56] References Cited

U.S. PATENT DOCUMENTS

| | | | |
|---|---|---|---|
| 4,466,011 | 8/1984 | Van Zanten | 307/303.1 |
| 4,626,770 | 12/1986 | Price | 323/313 |
| 4,628,248 | 12/1986 | Birrittella | 323/314 |
| 4,670,669 | 6/1987 | Cottrella | 307/296.2 |
| 4,849,684 | 7/1986 | Sonntag | 323/313 |

OTHER PUBLICATIONS

Design Techniques for IC Voltage Regulators Without p-n-p Transistors-Marks. Birrittell, Robert R. Marley and Keith D. Nootbaar, IEEE Journal of Solid State Circuits, vol. SC-22, No. 1, Feb. 1987, pp. 71-76.

*Primary Examiner*—Steven L. Stephan
*Assistant Examiner*—Adolf Berhane
*Attorney, Agent, or Firm*—Frank J. Bogacz

[57] ABSTRACT

A method and device for the generation of a bandgap reference voltage, compensating for temperature and input voltage fluctuations, in a device hardened against radiation. To generate a stable reference voltage output, the device provides a positive temperature coefficient voltage and a negative temperature coefficient voltage, compensating the positive temperature coefficient voltage with the negative temperature coefficient voltage to maintain the stable bandgap reference voltage output under temperature changes. In addition, input voltage fluctuations are tracked, and excess current is shunted to maintain the stable bandgap reference voltage output under voltage changes. An epi ring insulates the bandgap reference voltage generator sensitive nodes from excess leakage currents caused by radiation.

17 Claims, 2 Drawing Sheets

-PRIOR ART-

RADIATION HARDENED BANDGAP REFERENCE VOLTAGE GENERATOR AND METHOD

BACKGROUND OF THE INVENTION

This invention relates in general to the field of voltage generation, and, more particularly, to bandgap reference voltage generation.

Bandgap reference voltage generation is an important and integral part of integrated circuit (IC) design. Linear, custom, and memory circuits can require temperature and voltage compensation. In addition, logic families of both emitter-coupled logic (ECL) and common-mode logic (CML) require regulators. The function of a regulator in a logic circuit is to provide a reference voltage to supply a regulated potential across a resistor to create a current source for a particular gate. Designs using discrete components were the first to be used as IC regulators.

Particular difficulties occur in fully compensating voltage regulators for temperature and voltage variations. Voltage compensation refers to providing stable output for power supply changes. Temperature compensation refers to maintaining stable output while the voltage regulator experiences temperature fluctuations. Full compensation refers to maintaining stable voltage output under both temperature and power supply changes.

One traditional approach to voltage-compensation of voltage regulators has been to use P-N-P transistors as shunt devices for excess current generated by changes in the power supply. P-N-P transistors, however, are typically difficult to make, unreliable, and have poor current density capability. Additionally, P-N-P transistors have a temperature tracking problem which causes the temperature coefficient associated with the regulated output voltage, $V_{CS}$, to be less positive than desired.

Voltage compensation in P-N-P transistor designs was improved by replacing the P-N-P shunt device in the bandgap reference voltage generator with a differential amplifier. Using the reference voltages generated, the differential amplifier operates very similarly to the P-N-P device. While the problem associated with the production of P-N-P transistors is eliminated by using the differential amplifier, there remains a problem with current density tracking over temperature. It is desirable improve the tracking characteristics of the fully compensated differential amplifier voltage regulator throughout a wider range.

Temperature compensation to produce an output voltage, $V_{CS}$ or $V_{BB}$, with essentially zero temperature coefficient, is typically accomplished by summing two voltages having opposite temperature coefficients. The positive temperature coefficient can be produced by two transistors operated at different current densities. The base-emitter voltage of a third transistor which has a negative temperature coefficient can be combined with the positive temperature coefficient voltage to produce a composite voltage having a very low or zero temperature coefficient.

The differential amplifier voltage compensator can provide temperature compensation, with a high gain loop and the differential amplifier operating together to appropriately channel current as needed. The fully compensating differential amplifier voltage regulator can produce more consistent temperature tracking than the P-N-P type design. It is still desirable, however, to extend the temperature range of the fully compensated differential amplifier voltage regulator.

An additional problem with bandgap generators is that they are susceptible to radiation. When a bandgap generator is irradiated, leakage can occur particularly at high impedance nodes and can cause large shifts in the resultant output reference voltage. It is desirable to harden the fully compensated differential amplifier voltage regulator to decrease its radiation susceptibility.

SUMMARY OF THE INVENTION

A radiation hardened bandgap reference voltage generator is contemplated which includes a voltage supply and accompanying bias, voltage and temperature monitor and compensator, and alternate current path to dispose of excess current. The method and device provides for the generation of a bandgap reference voltage, compensating for temperature and input voltage fluctuations. The device is hardened against radiation.

To generate a stable reference voltage output, the device provides a positive temperature coefficient voltage and a negative temperature coefficient voltage, compensating the positive temperature coefficient voltage with the negative temperature coefficient voltage to maintain the stable bandgap reference voltage output under temperature changes. In addition, input voltage fluctuations are tracked, and excess current is shunted to maintain the stable bandgap reference voltage output under voltage changes. An epi ring insulates the bandgap reference voltage generator sensitive nodes from excess leakage currents caused by radiation.

The above and other features and advantages of the present invention will be better understood from the following detailed description taken in conjunction with the accompanying drawings.

DETAILED DESCRIPTION OF THE PREFERRED EMBODIMENT

Figure 1:
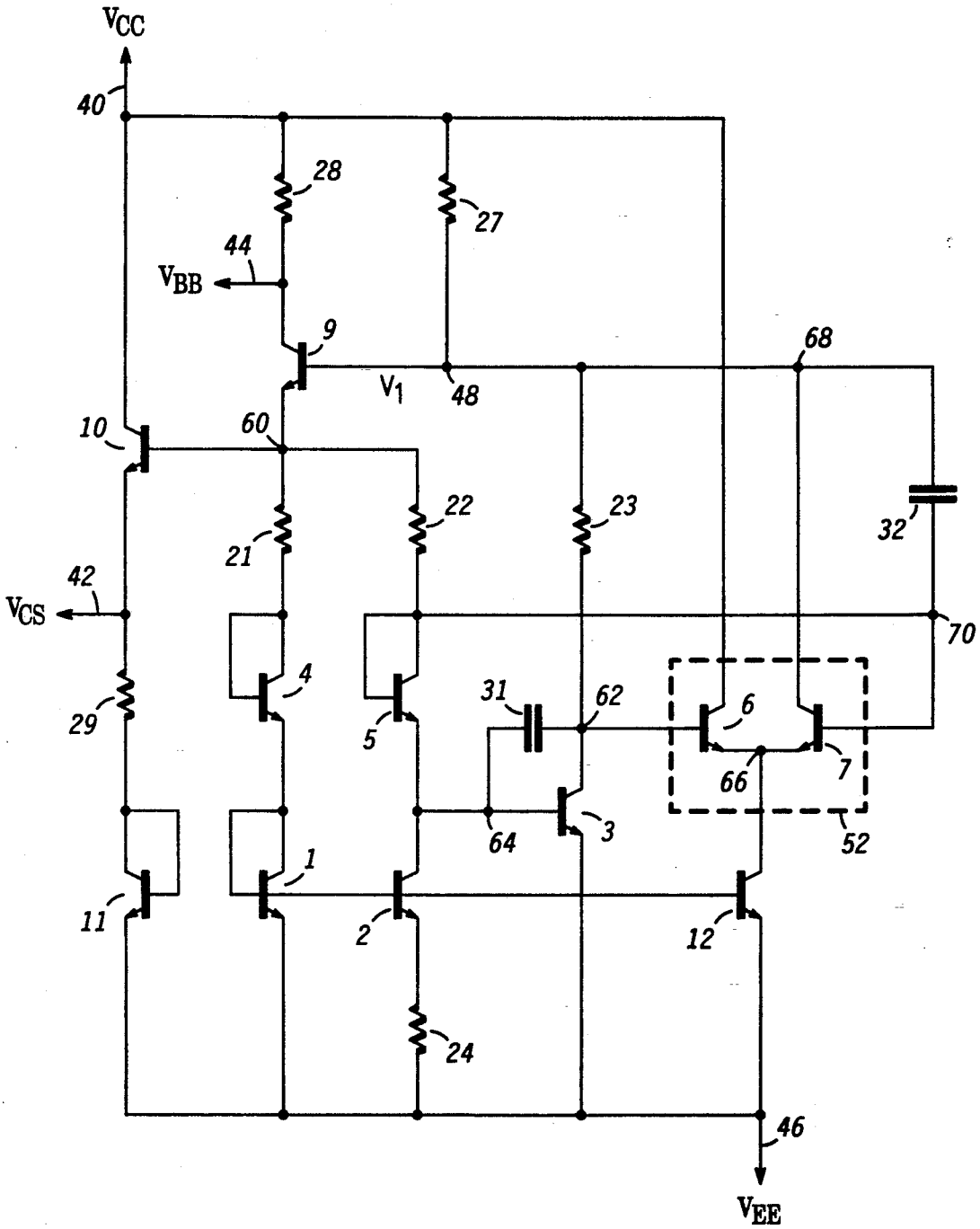
In FIG. 1 there is shown a circuit schematic of a compensated differential amplifier voltage regulator that is prior art.

In FIG. 1, there is a representation of a prior art circuit schematic of a compensated differential amplifier voltage regulator. A Widlar cell, comprising transistor 1 and 2 provides part of two current paths in which constant currents are maintained to produce a stable reference voltage output. A third constant current path is maintained through transistor 3. The remainder of the circuit functions as voltage change sensor and compensator to prevent changes in the currents through transistors 1, 2, and 3.

Structurally, the emitter of transistor 2 is coupled through resistor 24 to supply voltage $V_{EE}$ 46. The emitter of transistor 1 is coupled directly to supply voltage $V_{EE}$ 46. The base of transistor 1 is coupled to base of transistor 2 and to the collector of transistor 1. The collector of transistor 2 is coupled to junction 64.

Transistors 4 and 5 contribute to voltage and temperature compensation. The emitter of transistor 4 is coupled to the collector of transistor 1. The base of transistor 4 is coupled to the collector of transistor 4, which is connected through resistor 21 to junction 60 in the circuit. In parallel fashion, the emitter of transistor 5 is coupled to the collector of transistor 5. The base of transistor 5 is coupled to the collector of transistor 5. The collector of transistor 5 is coupled through resistor 22 to junction 60.

Junction point 60 is connected to the emitter of transistor 9. The base of transistor 9 is connected to junction 48 (to be maintained at voltage $V_1$), and the collector of transistor 9 is coupled to output $V_{BB}$ 44. $V_{BB}$ 44 is connected through resistor 28 to supply voltage $V_{CC}$ 40. Junction 48 is connected through resistor 27 to $V_{CC}$ 40.

$V_{CC}$ 40 also is connected to the collector of transistor 10. The base of transistor 10 is connected to junction 60, and the emitter of transistor 10 is connected to voltage supply $V_{CS}$ 42. $V_{CS}$ 42 also is connected through resistor 29 to the collector of transistor 11. The base of transistor 11 is coupled to the collector of transistor 11. The emitter of transistor 11 is coupled to supply voltage $V_{EE}$ 46.

Junction 48 is also connected to voltage supply $V_{CC}$ 40. Junction 48 is also connected through resistor 23 to junction 62. Junction 62 is coupled to both a first side of capacitor 31, and the collector of transistor 3. The second side of capacitor 31 is connected to junction 64, which is the electrical equivalent to the base of transistor 3 and the collector of transistor 2. The emitter of transistor 3 is coupled to $V_{EE}$ 46.

Junction 48 is also coupled to junction 68, which is electrically equivalent to the collector of transistor 7. Junction 68 is also connected through capacitor 32 to junction 70. Junction 70 is connected to both the base of transistor 7 and the base of transistor 5. The emitter of transistor 7 is connected to junction 66.

Supply voltage $V_{CC}$ 40 is connected to the collector of transistor 6. The base of transistor 6 is coupled to junction 62, and the emitter of transistor 6 is coupled to junction 66. Transistors 6 and 7 form a differential amplifier 52.

Junction 66 is connected to the collector of transistor 12. The base of transistor 12 is connected to the base of transistor 1 and 2, and the emitter of transistor 12 is connected to supply voltage $V_{EE}$ 46.

In operation, the differential amplifier 52 comprising transistor 6 and transistor 7 causes the currents in transistor 1, transistor 2, and transistor 3 to be proportional for all temperatures. The high gain loop and differential amplifier 52 operate together to channel current through or around transistor 3, as needed to provide compensation. The operation of the fully compensated differential amplifier voltage regulator is quite good at voltages ($V_{EE}$) between −4.68 v and −5.7 V, and temperatures ranging from −55 degrees Celsius to +125 degrees Celsius. Tracking characteristics are typically 7 milli-Volts/Volt (mV/V) for voltage and −0.08 mV/degree Celsius over temperature.

Still, at higher $V_{EE}$ voltages than −4.68 V voltage and temperature tracking increasingly degrade. This is especially true at $V_{EE}$ voltages above −4.4 V. Between −3.6 V and −4.4 V, voltage tracking characteristics increase to 40 mV/V and temperature tracking characteristics increase to above −0.150 mV/degree Celsius.

The degradation in tracking characteristics for the FIG. 1 fully compensated bandgap reference voltage generator at low power supply differential is primarily due to the over increase of current through resistor 27. In the FIG. 1 design, $V_1$ is to be maintained at approximately 3.5 $V_{BE}$ above $V_{EE}$ or approximately −2.8 V above $V_{EE}$. Resistor 27 supplies the current to be used by transistor 3 to maintain $V_{BE}$ tracking between transistors 1, 2, and 3. Any excess current is shunted around transistor 3 through the differential amplifier 52. Differential amplifier 52 monitors and compares the voltages 1.5 $V_{BE}$ below $V_1$ to ensure equivalent currents in transistors 1, 2, and 3. Thus, any change in power supply voltage will not affect $V_1$ and will result in the voltage across resistor 27 changing by the same incremental amount that the power supply changes. Any current changes through resistor 27 are then corrected by differential amplifier 52.

For the FIG. 1 design to be able to operate at low voltage, resistor 27 requires a smaller value to allow for the current that is needed for transistor 3. However, for even small resistors, the change across resistor 27 is so great that differential amplifier 52 is unable to compensate. For example, if the $V_{EE}$ voltage is varied from −4.4 V to −3.6 V, the potential across resistor 27 changes from 1.6 V to 0.8 V. This results in a 2:1 current change through resistor 27 which is too great for the differential amplifier 52 to handle efficiently, thus causing inaccuracies in voltage tracking. At the same time, because resistor 27 needs to be so much smaller than before, the circuit is more susceptible to variation caused by temperature, causing inaccuracies in temperature tracking.

Thus, even assuming no greater than a 500 mV potential drop across resistor 28, the overall design lends itself to be operational from −3.3 V to −6 V, but requires performance improvements to do so. Secondly, for operational power supplies below −4.68 V, the resistor 27 must be changed to allow for more current. In addition, both temperature and voltage tracking need performance improvement at lower power supply voltages.

Figure 2:
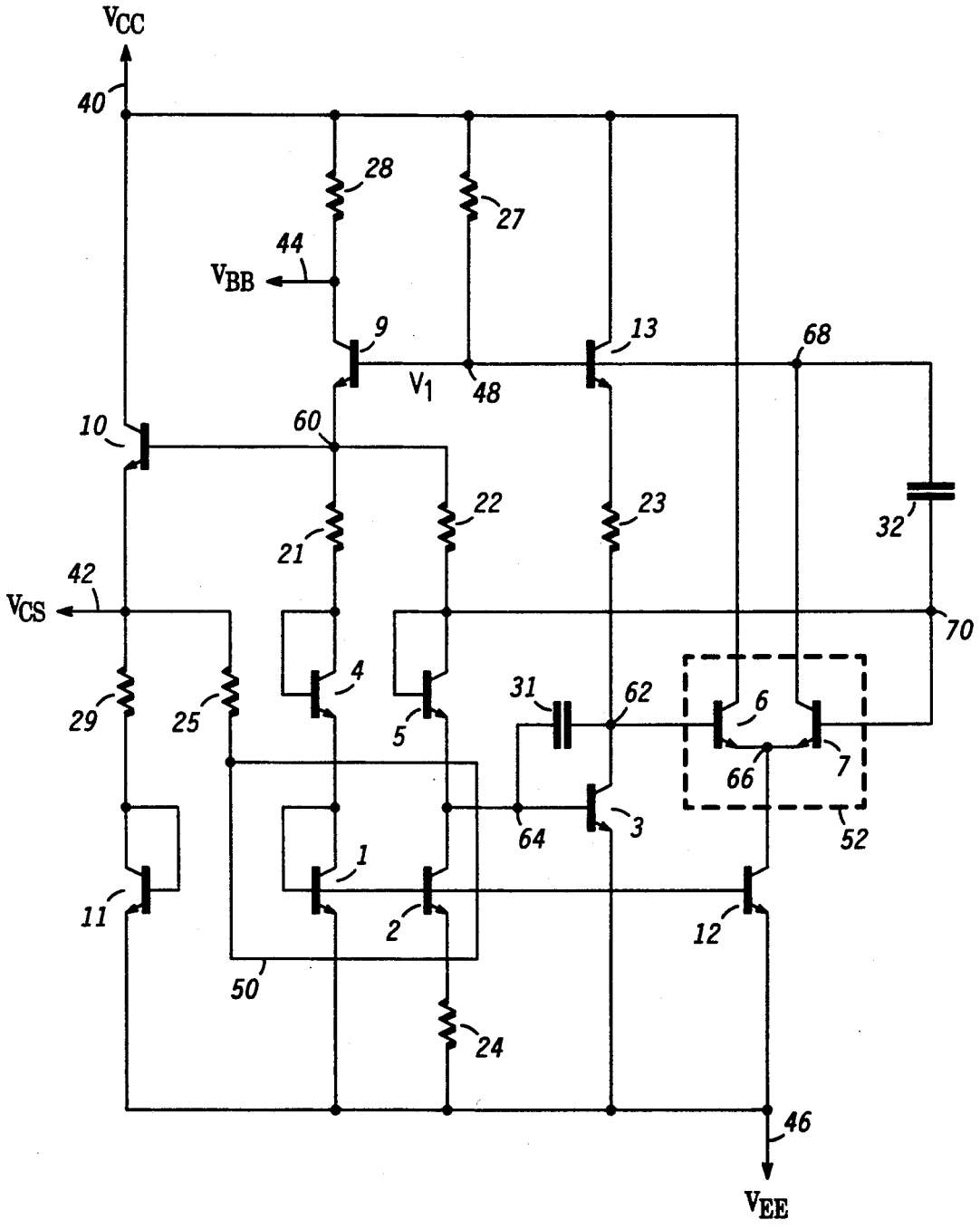
In FIG. 2, there is shown a circuit schematic of a fully compensated differential amplifier voltage regulator in accordance with a preferred embodiment of the invention.

Structurally, the bandgap reference voltage generator in FIG. 2 differs from FIG. 1 with respect to transistor 13, epi ring 50, and resistor 25. In FIG. 2, there is shown a schematic of a radiation hardened bandgap reference voltage generator with improved temperature and voltage range operation. The improved temperature and voltage compensation results from the introduction of transistor 13. From the FIG. 1 schematic, transistor 13 has been added. The collector of transistor 13 is connected to supply voltage $V_{CC}$ 40. The base of transistor 13 is coupled to voltage $V_1$ 48. The emitter of transistor 13 is coupled to resistor 23.

The design in FIG. 2 provides transistor 13 to be base driven at $V_1$. Transistor 13 supplies the current required for transistor 3, rather than resistor 27. Resistor 27 supplies base current for transistor 8 and 9, which are matched transistors. In this configuration, because of the low base current requirements of transistors 8 and 9, resistor 27 will be very large and any excess current will be shunted through differential amplifier 52 as before.

As the supply voltage increases, the current through transistor 13 will increase. Responding to this increase, the circuit will cause the potential of the base of transistor 6 to fall with respect to $V_{CC}$ and the base of transistor 7 to rise, thus sinking the excess current through transistor 7 and around resistor 23 and transistor 3. Excess current in resistor 23 gets channeled to transistor 7 as circuit balancing occurs, again sinking excess current around resistor 23 and transistor 3 through transistor 7. Also the current in resistor 29 is increased, such that the beta-current load in on the $V_{CS}$ 42 output is minimal compared to the total current in resistor 29. To maintain tracking through transistor 10, the current density of transistor 10 must match the current density of transistor 4 or transistor 5 for term cancellation.

The performance of the bandgap reference voltage generator of FIG. 2 is improved over a wide voltage range. For example, while the fully compensated differential amplifier voltage regulator of FIG. 1 has an operating threshold of approximately −4.68 Volts (V), many circuits require −5 V to operate, which the FIG. 2 bandgap reference voltage generator can easily accommodate.

Unlike the FIG. 1 bandgap reference voltage generator, the voltage changes across resistor 27 in the FIG. 2 design have a minimal effect on the used current. The current most affected is the shunt current through the differential amplifier. Also, any effect on the used base current will affect both transistors 8 and 9 equally, thereby maintaining the current density tracking of transistors 1, 2, and 3.

The FIG. 2 design provides excellent voltage supply tracking due to its high DC gain characteristics. Because of the high gain, compensation capacitors 31 and 32 are included across the base-collector of transistor 3 and the base-collector of transistor 7, respectfully, to compensate for possible phase error in the gain loops. Capacitors 31 and 32 can be approximately 4 picoFarads (pF) each.

Radiation hardening of the bandgap reference voltage generator is provided by epi ring 50. Epi ring 50 is constructed out of transistor collector material, physically surrounds transistors 1 and 2 (the Widlar cell), and is coupled through resistor 25 to supply voltage $V_{CS}$ 42. High impedance nodes are the most susceptible to excess leakage current caused by radiation. The epi ring 50 collector structure provides a drain for radiation-induced leakage currents through resistor 25 to $V_{CS}$ 42. Resistor 25 can be approximately a 2 kilo-ohm (kΩ) resistor. Since the leakage current to be drained are relatively small, $V_{CS}$ 42 can be used as an outlet.

Thus, a radiation hardened bandgap reference voltage generator has been described which overcomes specific problems and accomplishes certain advantages relative to prior art methods and mechanisms. The improvements over known technology are significant. While previous compensated differential amplifier voltage regulators have been restricted in voltage range to above −4.6, V, a preferred embodiment in accordance with the invention can achieve a wide supply voltage range of −4 V to −6 V. With respect to temperature, the fully compensated differential amplifier voltage regulator described has a wide temperature range of operation from −55 degrees Celsius to +125 degrees Celsius. In addition, the epi ring structure provides radiation hardening to decrease the radiation susceptibility of the fully compensated differential amplifier voltage regulator.

Thus, there has also been provided, in accordance with an embodiment of the invention, a radiation hardened bandgap reference voltage generator that fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

I claim:

1. A method for generating a bandgap reference voltage which is resistant to radiation, compensating for temperature and input voltage fluctuations, comprising the steps of:

providing an input voltage;

generating a stable bandgap reference voltage output;

creating a positive temperature coefficient voltage and a negative temperature coefficient voltage;

compensating the positive temperature coefficient voltage with the negative temperature coefficient voltage to maintain the stable bandgap reference voltage output under temperature changes;

tracking input voltage fluctuations; and shunting excess current through an alternate current path to maintain the stable bandgap reference voltage output under voltage changes; and insulating the bandgap reference voltage generation sensitive nodes from radiation-induced leakage currents by an epi ring to maintain the stable bandgap reference voltage output.

2. A method for generating a bandgap reference voltage as in claim 1, wherein the step compensating the positive temperature coefficient voltage with the negative temperature coefficient voltage to provide a stable bandgap reference voltage output comprises the step of providing at least two parallel current paths through a Widlar cell.

3. A method for generating a bandgap reference voltage as in claim 2 wherein the step of tracking input voltage fluctuations comprises the steps of:

monitoring the voltages across the at least two parallel current paths through the Widlar cell;

comparing the voltages across the at least two parallel current paths through the Widlar cell; and feeding back differences in the voltages across the at least two parallel current paths through the Widlar cell to a differential amplifier.

4. A method for generating a bandgap reference voltage as in claim 3 wherein the step of shunting excess current comprises the steps of:

changing the current through the differential amplifier by the same incremental amount as the input voltage fluctuations; and maintaining constant current through the at least two parallel current paths through the Widlar cell.

5. A method for generating a bandgap reference voltage as in claim 4 wherein the step of insulating the bandgap reference voltage generation from radiation comprises the step of surrounding the Widlar cell with an epi ring of transistor collector structure.

6. A method for tracking voltage fluctuations in a temperature-compensated differential amplifier bandgap reference voltage generator, comprising the steps of:

tracking input voltage fluctuations;

providing a scaled voltage change for current changes in the differential amplifier;

using the scaled voltage change to control the shunting of excess current; and insulating the voltage generator from radiation.

7. A method for tracking voltage fluctuations in a temperature-compensated differential amplifier bandgap reference voltage generator as in claim 6, wherein the step of tracking input voltage fluctuations comprises the steps of:

monitoring the voltages across the at least two parallel current paths through a Widlar cell;

comparing the voltages across the at least two parallel current paths through the Widlar cell; and feeding back differences in the voltages across the at least two parallel current paths through the Widlar cell to the differential amplifier.

8. A method for tracking voltage fluctuations in a temperature-compensated differential amplifier bandgap reference voltage generator as in claim 7, wherein the step of insulating the voltage generator from radiation comprises the step of surrounding the Widlar cell with an epi ring of transistor collector material.

9. A temperature and voltage compensating bandgap reference voltage generator comprising:

first voltage supply means;

bias means coupled to the first voltage supply means;

output means coupled to the bias means at a first junction and coupled to a second junction;

cell means for maintaining a constant voltage output from the output means;

low-voltage capable tracking means coupled to the cell means at a first cell junction and to the first junction;

compensating means coupled to the second junction, coupled to the cell means, and coupled to the low-voltage capable tracking means to maintain the constant voltage output;

shunt means coupled to the low-voltage capable tracking means, coupled to the first junction, and coupled to the cell means to provide a current bypass;

second voltage supply means coupled to the cell means, coupled to the low-voltage capable tracking means, and coupled to the shunt means;

third voltage supply means coupled to the compensating means and coupled to the second voltage supply means at a third junction; and epi ring means coupled to the third voltage supply means through a second resistor, the epi ring means for decreasing radiation susceptibility in the bandgap reference voltage generator.

10. A bandgap reference voltage generator as claimed in claim 9 wherein the low-voltage capable tracking means comprises:

a first tracking means transistor with collector coupled to the first voltage supply means, base coupled to the first junction, and emitter;

a first tracking means resistor comprising a first side coupled to the emitter of the first tracking means transistor and a second side; and a second tracking means transistor comprising a collector coupled to the second side of the first tracking means resistor, a base coupled to the collector through a capacitor and the base also coupled to a first cell junction, and an emitter coupled to the second voltage supply means.

11. A bandgap reference voltage generator as claimed in claim 10 wherein the output means comprises a output transistor including a collector coupled to the bias means, base coupled to the first junction, and emitter coupled to the second junction.

12. A bandgap reference voltage generator as claimed in claim 10 wherein the cell means comprises:

a Widlar cell comprising a first cell means transistor and a second cell means transistor;

the first cell means transistor comprising a base coupled to a collector, the common base and collector connection coupled to a second cell junction, and an emitter coupled to the third junction; and the second cell means transistor comprising a collector coupled to a third cell junction, a base coupled to the second cell junction, and an emitter coupled through a resistor to the third junction.

13. A bandgap reference voltage generator as claimed in claim 10 wherein the compensating means comprises:

a first compensating means transistor comprising a collector coupled through a first resistor to the second junction, a base coupled to the collector, and an emitter coupled to the second cell junction;

a second compensating means transistor comprising a collector coupled through a second resistor to the second junction, a base coupled to the collector, and an emitter coupled to the third cell junction; and a third compensating means transistor comprising a collector coupled to the first voltage supply means, a base coupled to the second junction, and an emitter coupled to the third voltage supply means.

14. A bandgap reference voltage generator as claimed in claim 13 wherein the shunt means comprises:

differential amplifier means comprising first and second shunt means transistors;

the first shunt means transistor comprising a collector coupled to the first voltage supply means, a base coupled to the low-voltage capable tracking means, and an emitter coupled to an emitter junction; and the second shunt means transistor comprising a collector coupled to the first junction, a base coupled to the collector of the second transistor of the compensating means, and an emitter coupled to the emitter junction.

15. A bandgap reference voltage generator as claimed in claim 14 wherein the shunt means further comprises a third shunt means transistor comprising a collector coupled to the emitter junction, a base coupled to the second cell junction, and an emitter coupled to the second voltage supply means.

16. A bandgap reference voltage generator as claimed in claim 12 wherein the epi ring means surrounds the Widlar cell to decrease radiation susceptibility.

17. A bandgap reference voltage generator as claimed in claim 16 wherein the epi ring means comprises transistor collector material.

* * * * *